US005785223A

United States Patent [19]

Matsushita

[11] Patent Number: 5,785,223

[45] Date of Patent: Jul. 28, 1998

[54] BOOT CARRIER FOR SPORTS ARTICLES

[76] Inventor: Paul H. Matsushita, 151 N. Maple St., Unit 103, Burbank, Calif. 91505

[21] Appl. No.: 735,125

[22] Filed: Oct. 22, 1996

[51] Int. Cl.[6] ..... A45F 3/00

[52] U.S. Cl. ..... 224/609; 224/257; 294/170; 294/96; D3/261; D3/317

[58] Field of Search ..... 224/257, 258, 224/607, 608, 609; 294/94, 96, 154, 159, 162, 165, 170; 36/132, 136; D2/979; D3/221, 222, 261, 315, 317

[56] References Cited

U.S. PATENT DOCUMENTS

| | | | |
|---|---|---|---|
| 2,150,713 | 3/1939 | Davis | D2/979 |
| 3,729,759 | 5/1973 | Szabo | D2/979 |
| 3,794,369 | 2/1974 | Hnatko | 294/96 |
| 4,242,813 | 1/1981 | Quance | 294/159 |
| 4,483,470 | 11/1984 | Cousins | 224/257 |
| 4,669,772 | 6/1987 | Waller, Jr. | 294/162 |
| 4,867,359 | 9/1989 | Donovan | 224/609 |
| 5,274,933 | 1/1994 | Cole et al. | 36/136 |
| 5,335,835 | 8/1994 | Hogan | 224/257 |
| 5,513,787 | 5/1996 | Reed | 224/609 |

*Primary Examiner*—Henry J. Recla
*Assistant Examiner*—Gregory M. Vidovich
*Attorney, Agent, or Firm*—Roger A. Marrs

[57] ABSTRACT

A boot carrier having a pair of support members insertable into the interior of each boot to bear against the inside heel portion of each boot. A retainer device taking the form of an expandable, segmented clam-shell type or a buckled strap is employed to releasably secure the carrier to each boot. A tether strap detachably connects the pair of support members together for grasping by the user in order to transport the boots from place to place. Each boot may have a sports article attached such as a set of roller blades, snow skis or the like.

3 Claims, 2 Drawing Sheets

BOOT CARRIER FOR SPORTS ARTICLES

BACKGROUND OF THE INVENTION

1. Field of the Invention

The present invention relates to the field of carriers and totes for sports articles such as skis, roller skates, blade skates or the like, and, more particularly to a novel carrier having adjustable means insertable into the interior of a boot and which includes strap means for retaining the insertable means in the boot while the pair of boots is transported or carried from place to place.

2. Brief Description of the Prior Art

In the past, a need has existed to carry or transport sports articles from place to place preparatory for entering the sport or at the termination of play. In this connection, the need has increased over the years since such items as boots, roller blades, skis and the like have become heavier and more rigidly constructed for player or participant protection and support.

Particularly, in the field of roller blades, the rollers are carried on a frame integrally attached to the sole of a boot which includes an ankle portion that substantially surrounds the ankle or lower leg of the user. Such boots are heavy, come in pairs and are greatly over-sized as compared with shoes or conventional shoe boots. These physical features present difficulty to the user in carrying the roller blades, including boots, from one place to another when they are not being worn during the sport activity.

Attempts have been made to provide suitable means for transporting a pair of such sports articles from one place to another, which have included special cases, containers and carrying frames. One such attempt is disclosed in U.S. Pat. No. 5,509,689 which discloses a suitcase or a handle for carrying the skates. It can be seen that there is no attachment of the suitcase with the skates and the engagement of the skates or placement of the skates within the suitcase is strictly external. Also, an external four-wheeled skate carrier is disclosed in U.S. Pat. No. 4,331,357 and again the engagement or connection between the carrier and the skates is external. Neither one of these examples are adjustable to compensate for boot size and neither of the disclosures is concerned with adjustability or internal engagement of the carrier with the sports article or product being carried.

Therefore, a long-standing need has existed to provide a novel carrier for heavy sports articles, such as roller blades, skis or the like that will adjust to the boot size and which provides an internal attachment with the boot.

SUMMARY OF THE INVENTION

Accordingly, the above problems and difficulties are avoided by the present invention which provides a novel carrier for boots attached to sports articles, such as skates or skis, whereby the carrier is releasably attached to each boot of a pair by internal insertion and engagement of a support member and which further includes straps for releasably securing the support member to the boot. In one form of the invention, the support member includes a rigid rod which may include an expandable or clam-shell means at one end whereby the rigid support member may be detachably connected to the interior of the boot through an interference fit. In another form, the rigid support member may be placed against the interior heel portion of the boot and in both instances, strap means are provided for securing the support member to the boot. The strap means forcibly urges the support member into position on the interior of the boot and serves to carry load forces into the straps and particularly into a tether strap which joins the pair of boots together.

Therefore, it is a primary object of the present invention to provide a boot carrier which is a simple and convenient means for carrying recreational ski or skate boots when not in use.

Another object of the present invention is to provide a novel boot carrier which includes structure for quickly attaching to the boot with minimal effort and which provides load-carrying capabilities.

Another object of the present invention is to provide a novel boot carrier which incorporates an adjustable expansion feature permitting the carrier to fit a variety of boot sizes and wherein the weight of the boot will work to self-tighten the fit while the boots are being carried.

Yet another object of the present invention is to provide an adjustable feature in the boot carrier wherein when the adjustable means is expanded, an expanding sleeve will receive a "fluted" structure that will permit air to circulate and allow the boot to breathe.

Still a further object of the present invention is to provide a boot carrier which is quick and simple to attach to a boot for carrying purposes and which includes a tether strap which may be held in the hand of the user or may be placed on the shoulder of the user.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
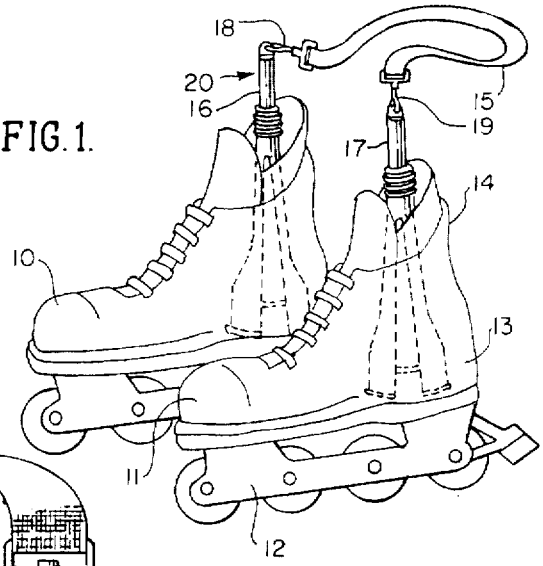
FIG. 1 is a perspective view of a pair of combined roller blades and boots joined together by the inventive boot carrier of the present invention.

Referring to FIG. 1, a pair of boots is indicated by numerals 10 and 11, which represent sports articles which are normally worn on the feet of the user during a course of play or during a game. In the present illustration, the boots 10 and 11 are attached to roller blades, such as indicated by roller blade 12 associated and integrally carried on the sole of boot 11. The boots are considered conventional for sports use and include a heel portion 13 with an upright ankle portion 14. The inside of the boot is hollow and includes an opening through the ankle portion 14 into which a person can normally insert his foot.

When it is desired to transport or carry the pair of boots 10 and 11 from one place to another, it is convenient to use the device of the present invention which is indicated in the general direction of arrow 10. The present invention includes a tether strap 15 which joins the upper end of support members 16 and 17 which are insertably placed through the opening of the ankle portion 14 of each of the respective boots. The tether strap 15 includes fasteners 18 and 19 which can be selectively coupled to the end of the support members and the strap 15 may be held in the hand of the user or when adjusted for length, be slung over the shoulder of the user.

Figure 2:
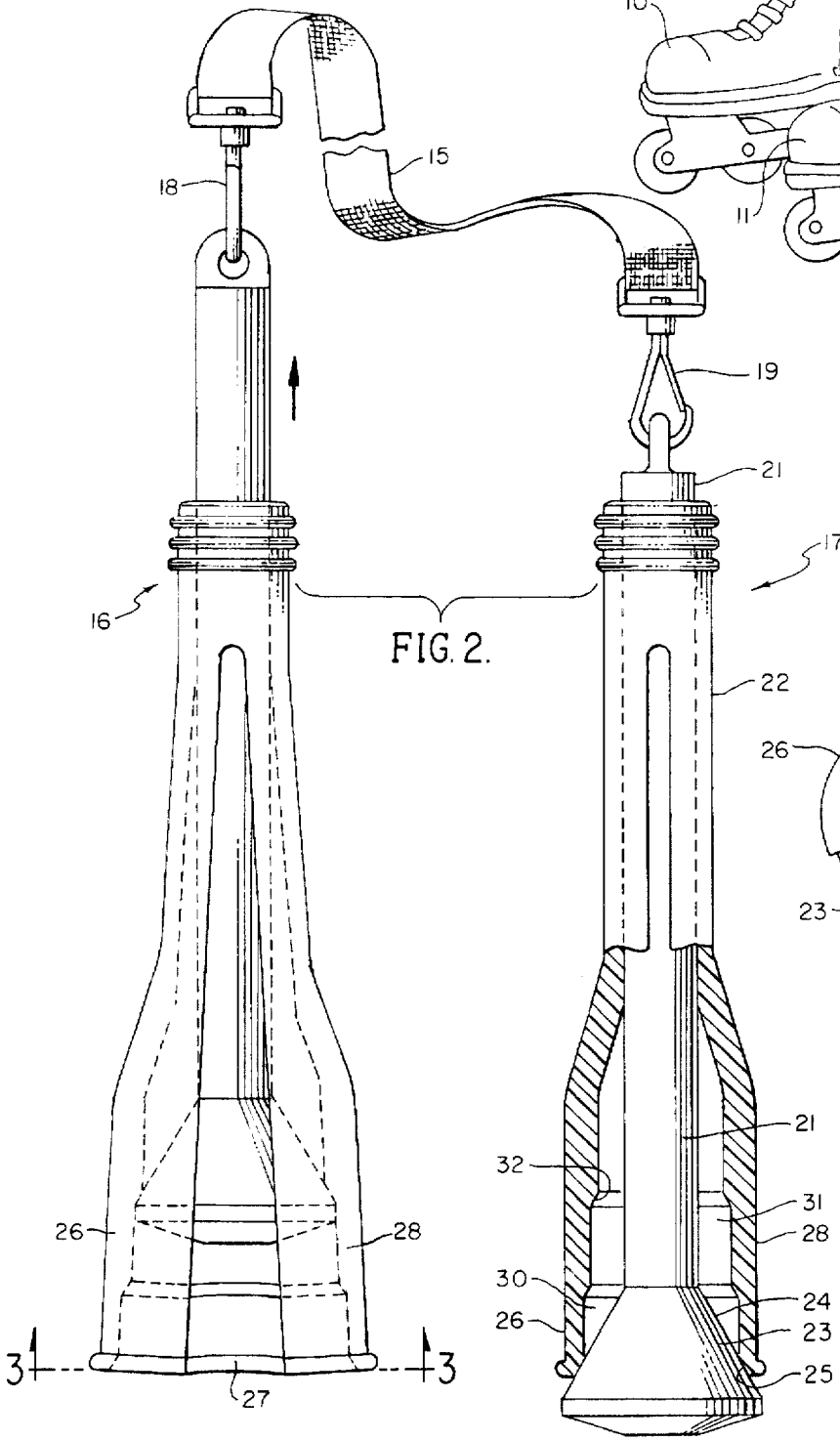
FIG. 2 is an enlarged front elevational view, partly in section, of the novel boot carrier employed in the illustration of FIG. 1.
Figure 3:
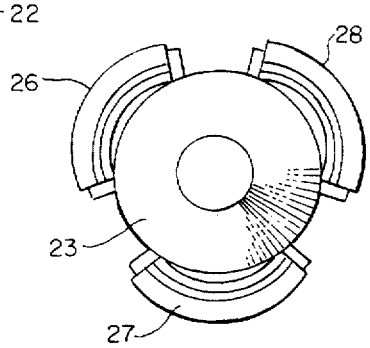
FIG. 3 is a view of the support member used in the boot carrier of FIG. 2 as taken in the direction of arrows 3—3 thereof.

Referring now in detail to FIG. 2, it can be seen that each of the support members 16 and 17 includes a rod 21 which is slidably disposed within a tube 22. The ends of the rod and tube which are associated with each other are provided with an adjustable means for expanding the diameter or width of the end of the support member so that it may engage with the inside surfaces of the user's boot into which it has been inserted. The end of the rod 21 is identified by numeral 23 and it can be seen that the end is expanded in a tapering manner so that the tapered surface 24 will engage with and bear against surfaces such as surface 25 associated with at least each of three segments formed at the end of the sleeve 22. The sleeves are identified by numerals 26 and 27 in FIG. 3 in addition to the segment 28. Therefore, it can be seen that as the rod 21 is pulled upwardly through the sleeve 22, the tapered surface of the enlarged end 23 will cause the segments 26, 27 and 28 to outwardly expand and thereby enlarge the entire end of the support member 17. It is this enlargement which will engage with the inside surfaces of the boot adjacent to the ankle sec t ion 14. Furthermore, in order to adjust for different sized boots, it can be seen that the segmented end of the sleeve 22 includes at least two adjustments in that the first adjustment is effected when the enlarged end 23 resides within a chamber 30 which is of a certain diameter. However, when the rod 21 is pulled further through the sleeve, the enlarged end will reside within the chamber 31 since its tapered surface 23 will bear against inner surfaces 32 of each segment. The further the enlarged end 23 progresses into the chambers or cavities of the sleeve 22, the further outward projection of the segments will take place. Therefore, in order to accommodate large or extra large boots, the member 21 is pulled through the sleeve 22 until the enlarged end 23 resides within the chamber 31 and bears against the tapered inner surfaces 32.

Referring to FIGS. 4–7 inclusive, another version or embodiment of the invention is illustrated in which the opposite ends of the tether strap 15 are connected to eyelets 40 and 41 of separate rigid and elongated rods 42 and 43. As noted in FIG. 4, the opposite ends of rods 41 and 42 which are opposite to the connection of the tether strap terminate in rounded ends 44 and 45. Furthermore, the rods 41 and 42 include a slot, such as slot 46, through which a retainer strap 47 is trained. New roll 48 designates the retainer strap associated with rod 43. As illustrated, the straps pass through their respective slots 46 and continue about opposite sides of the rod so as to pass along the rounded end 44 and 45 of the respective rods. The opposite ends of the straps are detachably connected together by a suitable buckle arrangement, such as indicated by numeral 50 for strap 47 and numeral 51 associated with strap 48.

It is also to be noted that the rods 42 and 43 are covered by the cushion sleeve, such as sleeve 52 associated with rod 43 and cushion 54 associated with rod 42. The rods have a bottom groove 49 that accepts the strap 47 when the carrier is not in use.

Figure 5:
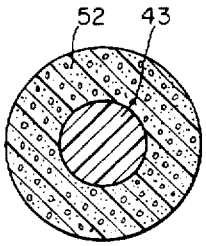
FIG. 5 is a transverse cross-sectional view of the support member used in the embodiment shown in FIG. 4 as taken in the direction of arrows 5—5 thereof.

It is to be noted in FIG. 5 that the cushion sleeve 53 is coaxially displaced with respect to the rod 43 on which it is installed. An identical arrangement is provided on rod 42 with sleeve 53.

Figure 4:
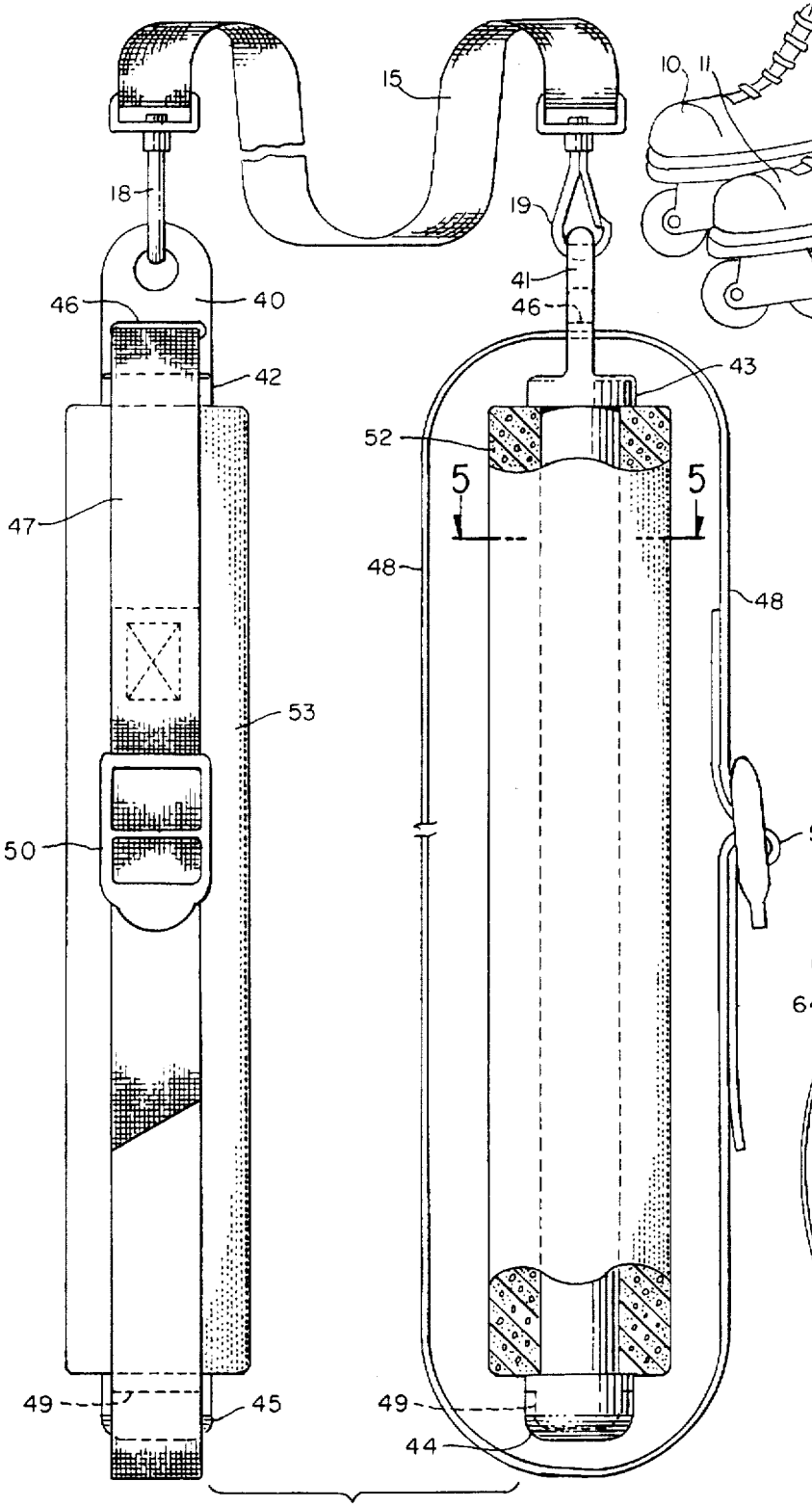
FIG. 4 is a view similar to the view of FIG. 2 illustrating another version of the present invention for carrying a pair of boots.
Figure 6:
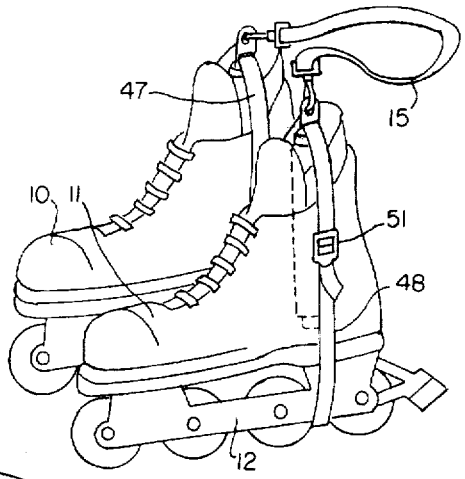
FIG. 6 is a front elevational view of a pair of boots joined together by the carrier shown in FIG. 4.

Referring now in detail to FIG. 6, installation of the boot carrier illustrated in FIG. 4 is provided wherein the cushion rods 42 and 43 are inserted into the interior of the boot adjacent to the heel portion of each boot and the straps of 47 and 48 are trained about the exterior of the boot and the skate blade 12 followed by buckling of the opposite ends of the straps together. When drawn taut, the rods bear against the heel of each of the respective boots and the strap retains the rods in position. The rigid rods serve to carry applied loads from the weight of the boots and skate blades into the carrying or tether strap 15 and into the support therefor whether it be the arms of the user or placed on a hook, hanger or the like.

Figure 7:
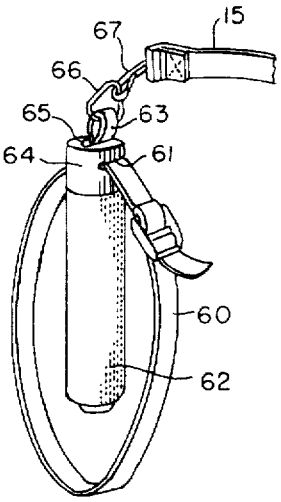
FIG. 7 is a front perspective view illustrating another version of a support member.

Another embodiment of the invention is illustrated in FIG. 7 in which the retainer strap, as indicated by numeral 60, is trained through a slot 61 at the upper end of the cushioned rod 62. The strap 60 includes a portion 63 which is inserted into an interior cavity in the top 64 of the rod and the portion 63 is then drawn through a top slot 65 where the portion forms a loop intended to be detachably connected with an eyelet 66 by fastener 67 carried on the end of the tether or carry strap 15. It is to be understood that a pair of rods and straps is provided, one for each boot, as described above. Installation of the rods into the interior of the boots is as described above as well.

In view of the foregoing, it can be seen that the boot carrier of the present invention provides a relatively inexpensive means and convenient means for detachably connecting to a pair of boots so that the boots may be transported from one place to another or may be supported in a storage area in a hanging position. The weighted load of the boots is distributed through the rigid rods and carrying strap into the supporting structure and there is no rigid or damaging connection between the carrier and the boots or skate blades.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A boot carrier comprising:

a pair of support members each intended to be inserted into the interior of a respective boot;

means carried on each said support member for carrying said support members and the respective boots from place to place;

means carried on each said support member for releasably retaining said support members to the respective boots;

said carrying means includes a tether strap detachably connected to each of said support members;

each said releasable retaining means includes an elongated retaining strap carried on said support member adapted to be secured about the exterior of the boot whereby said support member is forcibly urged into the interior of the boot.

2. The boot carrier of claim 1 wherein:

each said support member having opposite ends, said retaining strap slidably carried on one end of said support member and the other end of said support member being rounded; and each said support member includes a cushion sleeve carried on said support member such that said opposite ends of said support member extend beyond respective ends of said sleeve.

3. The boot carrier of claim 2 wherein:

said one end further includes a first open slot for slidably receiving said retaining strap;

said retaining strap having a loop portion;

said one end further having a second slot in communication with said first slot and normal thereto for receiving said loop portion wherein said tether strap detachably couples with said loop portion of said retaining strap.

* * * * *